US005452477A

United States Patent [19]

Mann

[11] Patent Number: 5,452,477

[45] Date of Patent: Sep. 26, 1995

[54] ITEM OF SWIMMING WEAR

[76] Inventor: Ho-Keung Mann, Flat B, 7th Floor, 171 Sai Yee Street, Kowloon, Hong Kong

[21] Appl. No.: 206,883

[22] Filed: Mar. 7, 1994

[30] Foreign Application Priority Data

Aug. 27, 1991 [GB] United Kingdom ..... 2259237

[51] Int. Cl.[6] ..... A41D 5/00

[52] U.S. Cl. ..... 2/67; 2/2; 441/116; 441/102

[58] Field of Search ..... 2/67, 2, 69, 228, 2/238, 227, 102, 103, 106, 120, 116; 441/102, 103, 106, 120, 116

[56] References Cited

U.S. PATENT DOCUMENTS

| | | | |
|---|---|---|---|
| 2,329,093 | 9/1943 | Sommers et al. | 441/102 |
| 3,094,722 | 6/1963 | Lerner | 441/102 |
| 3,134,994 | 6/1964 | Christofferson | 441/102 |
| 3,201,808 | 8/1965 | Glass | 441/102 |
| 3,204,264 | 9/1965 | Tamura et al. | 441/102 |
| 4,052,762 | 10/1977 | Zawislar | 441/102 |
| 4,291,427 | 9/1981 | Rhea . | |
| 4,538,998 | 9/1985 | Holzel . | |
| 5,013,271 | 5/1991 | Bartlett | 441/102 |
| 5,184,968 | 2/1993 | Michalochick et al. | 441/102 |

FOREIGN PATENT DOCUMENTS

| | | |
|---|---|---|
| 720039 | 11/1952 | United Kingdom . |
| 1383363 | 3/1972 | United Kingdom . |

*Primary Examiner*—Andrew M. Falik
*Assistant Examiner*—Gloria Hale
*Attorney, Agent, or Firm*—Michael J. Folise

[57] ABSTRACT

An item of swimming wear (10) arranged to be worn closely to the body of a user to provide or enhance buoyancy, which item (10) comprises a piece of flexible closed-cell foam material (12) combined with a piece of textile or plastics material (11).

20 Claims, 2 Drawing Sheets

FIG. 1
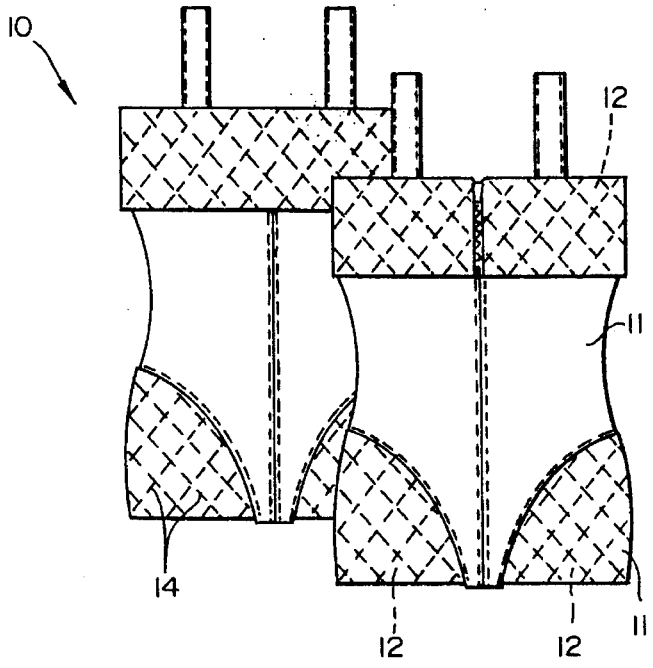
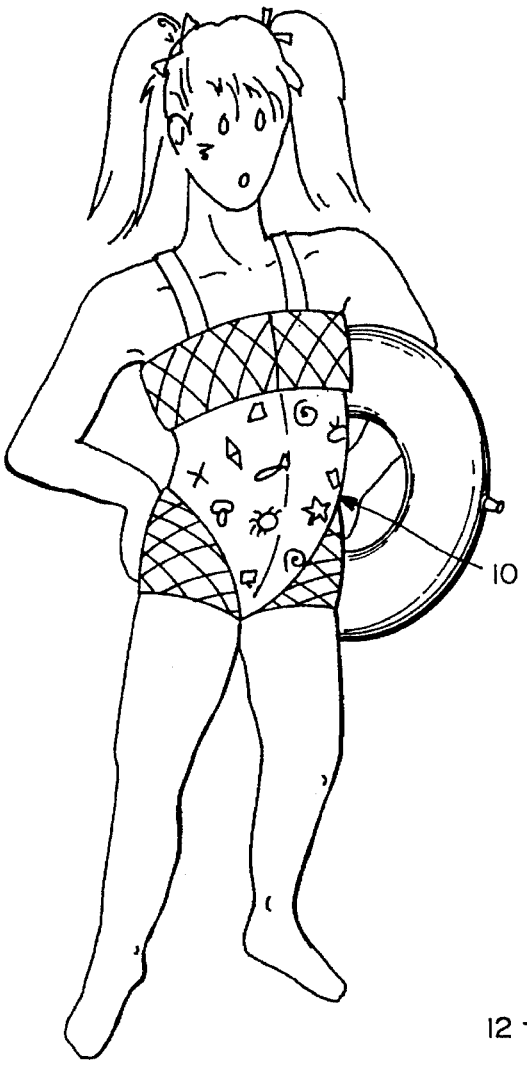
FIG. 2
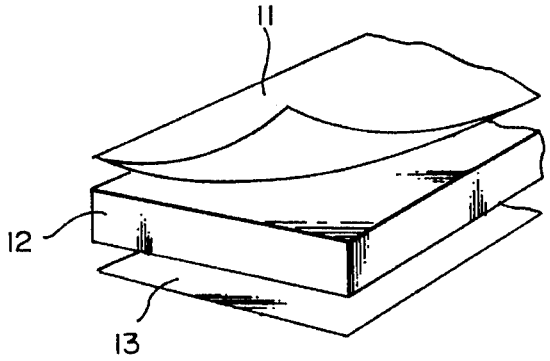
FIG. 3

FIG. 4
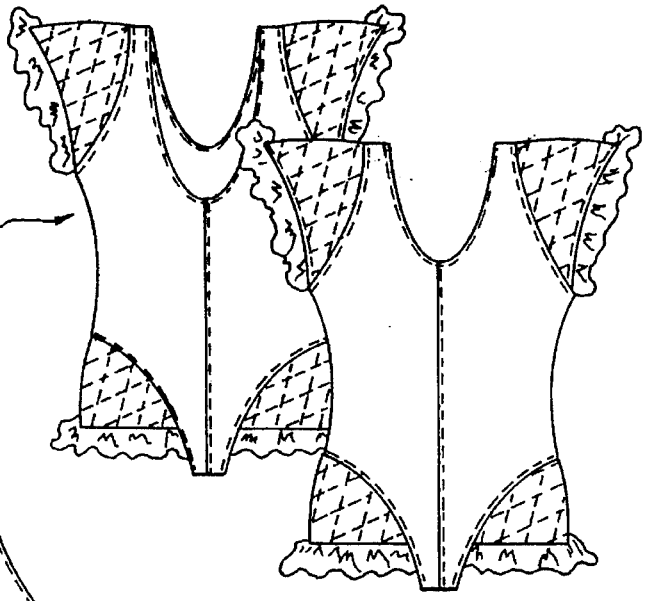
FIG. 5
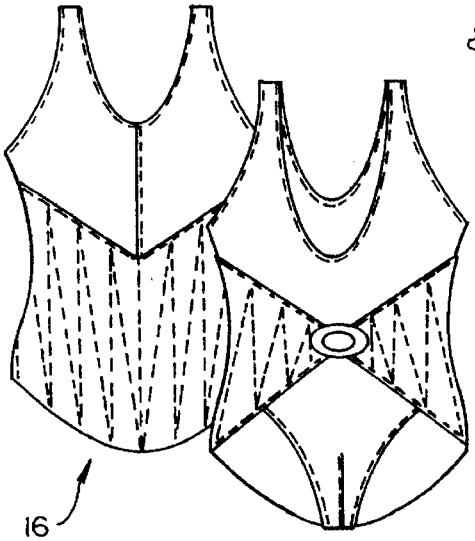
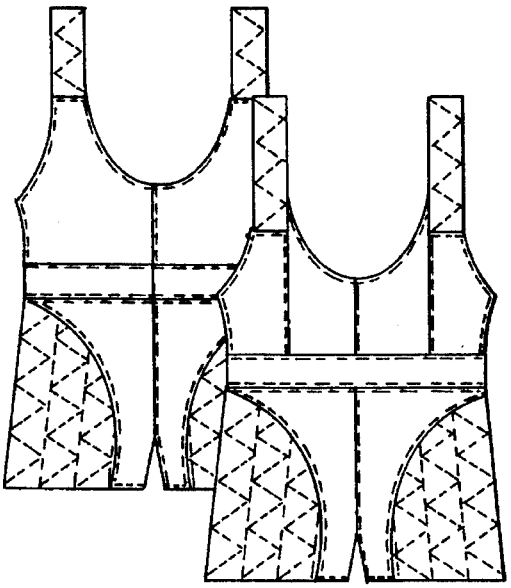
FIG. 6
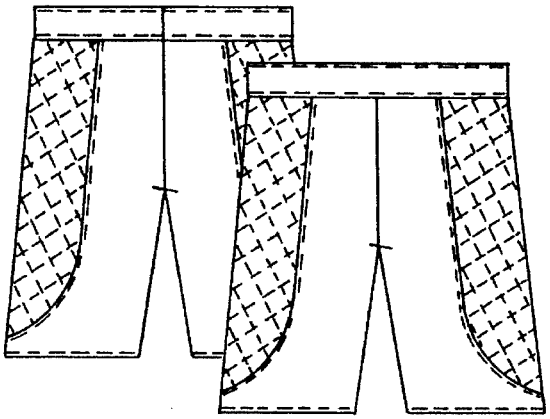
FIG. 7

ITEM OF SWIMMING WEAR

The present invention relates to an item of swimming wear which provides or enhances buoyancy for a user.

It is known to have life-jackets which are air-inflated but normally bulky and therefore not convenient to use for swimming. More importantly, they are vulnerable to puncture which can be dangerous to the users, particularly to swimming learners. It is therefore not recommended to rely on such devices in water. Some buoyancy aids are made of hard foam material, but they suffer from disadvantages especially as they are too easily or accidentally to be separated from the users through improper use, loss of grip or balance. Life-jackets are also known to be inlaid with rigid buoyant foam material, but they are not convenient and comfortable to wear and are not normally useful for swimming.

The invention seeks to provide an item of swimming wear which at least reduces the aforesaid disadvantages.

According to the invention, there is provided an item of swimming wear arranged to be worn closely to the body of a user to provide or enhance buoyancy, which item comprises a piece of flexible closed-cell foam material combined with a piece of textile or plastics material.

It is preferred that the closed-cell foam material is elastic, and that the piece of closed-cell foam material is in the form of a sheet or pad.

Preferably, the piece of closed-cell foam material is surrounded by the piece of textile or plastic material or sandwiched between two such pieces.

Advantageously, the pieces of closed-cell foam material and textile or plastics material are held closely together by lines of stitching.

The lines of stitching may in use slant across the body of a said user. In particular, the lines of stitching may be divided into two groups of parallel lines crossing one another or extending in a zig-zag pattern.

In a preferred embodiment, the closed-cell foam material has a minimum void percentage of 80% by volume and may be substantially of neoprene polymer.

The aforesaid item of swimming wear may be in the form of a band or sleeve or a swimming costume.

The invention will now be more particularly described, be way of example only, with reference to the accompany drawings, in which:

FIG. 1 is a front and rear view of a first embodiment of an item of swimming wear in accordance with the invention;

FIG. 2 shows a user wearing the item of swimming wear of FIG. 1;

FIG. 3 shows the general construction of a buoyant part of the item of swimming wear of FIG. 1; and FIGS. 4 to 7 are front and rear views of second to fifth embodiments of an item of swimming wear in accordance with the invention.

Referring firstly to FIGS. 1 to 3 of the drawings, there is shown a first embodiment of an item of swimming wear according to the invention, which is in the form of a one-piece swimming suit 10 for ladies. The swimming suit 10 is principally made, for its front layer 11, from textile fabric of 83% polyamide and 17% elasthan material. Buoyancy is provided by three sheets 12 of buoyant material which are placed at the top (around the chest of a wearer) and at the bottom (around the thighs' of a wearer) of the swimming suit 10.

Each sheet 12 of buoyant material is made of 100% neoprene polymer foam which has numerous internal closed voids or cells. The material in this particular embodiment has an average density of 0.18 to 0.24 g/c.c. and a minimum void or closed-cell percentage of 80 by volume.

The manner in which the sheets 12 of closed-cell foam material are attached onto the swimming suit 10 will now be described. The parts of the swimming suit 10 where the buoyant sheets 12 are provided are lined with an inner layer 13 of lycra brand material. Each buoyant sheet 12 is sandwiched between the outer and inner layers 11 and 13, and the three layers 11 to 13 are held closely together by lines 14 of stitching all over the sheet 12.

The buoyant sheets 12 are both flexible and elastic, by virtue of the physical properties of neoprene polymer material, which in conjunction with the resilience of the outer and inner layers 11 and 13 render the overall swimming suit 10 resilient so that the swimming suit 10 can be tightly worn comfortably by a wearer. In other words, the buoyant sheets 12 are arranged in use to lie generally against the body of the wearer and to be held suitably fixed in position. This arrangement is preferred because the buoyancy force provided by the buoyant sheets 12 will not normally shift or be displaced relative to the wearer's body so that the wearer can confidently rely upon the buoyancy force and readily gain balance.

In order to permit the swimming suit 10 to expand on a wearer's body, the stitching lines 14 are arranged to run slantingly across the body of the swimming suit 10. More specifically, the stitching lines 14 are divided into two groups of parallel lines crossing each other to form a rhomboid pattern.

It will be appreciated that the buoyant sheet or sheets may be simply attached or stitched onto the inner side of the swimming suit principal layer without any lining or on the outer side of the swimming suit. In a different embodiment, the buoyant sheet or sheets may form part of the principal layer of the swimming suit.

FIGS. 4 and 5 show the second and third embodiments 15 and 16 of an item of swimming wear according to the invention, which are also each in the form of a one-piece swimming suit for ladies. The buoyant sheets or pads are provided on both shoulder parts and the thigh parts of the swimming suit 15. In the swimming suit 16, a single sheet of buoyant material is used which is provided around the waist part.

Referring now to FIGS. 6 and 7, two further, fourth and fifth embodiments of an item of swimming wear according to the invention are shown which are basically swimming trunks 17 and 18 for men. The swimming trunks 17 have buoyant sheets or pads provided on both sides as well as the two shoulder belts as shown, whereas the swimming trunks 18 have buoyant pads only on the two sides but the buoyant pads are designed to be relatively longer to provide adequate buoyancy.

As shown in FIGS. 4 to 7, the stitching lines on the buoyant sheets or pads may be arranged to form a triangular or zig-zag pattern in order to provide a different visual appearance.

It will be understood that the amount of the buoyancy force is determined by the volume of the buoyant sheets or pads, and the area and thickness of the buoyant sheets or pads can therefore be chosen to suit a particular design or user's weight. Also, the closed-cell foam material may be made in any shape other than sheet-like, such as in the form of elongate pieces or rods which are attached onto the swimming suits as described or by glue.

The location and shape of the closed-cell foam material provided on the swimming suits are specially designed in order to provide a user with balanced bouyancy.

Apart from being in the form of a swimming costume, the item of swimming wear may also be made in the form of a band or sleeve to be fit around or closely to the wearer's body.

The invention has been given by way of example only, and various other modifications of or alterations to the described embodiments may be made by persons skilled in the art without departing from the scope of the invention as specified in the appended claims.

I claim:

1. A swimsuit arranged to be worn closely to the body of a user to enhance buoyancy, comprising:

a piece of flexible, elastic closed-cell foam buoyancy material; and, a piece of textile material forming a main body of the swimsuit, the piece of buoyancy material connected to the main body by first and second sets of elongated, substantially parallel, spaced apart sew lines passing through the buoyancy material and the textile material at regular intervals wherein each set is oriented substantially transverse to each other and to both longitudinal and lateral axes defined by the body of the user so that the buoyancy material remains substantially in contact with the user's body as the user swims.

2. The swimsuit of claim 1, wherein the first and second sets define an array of rhomboidal areas.

3. The swimsuit of claim 2, wherein the rhomboidal areas have major and minor axes positioned substantially transverse to the longitudinal axis.

4. The swimsuit of claim 1, wherein the swimsuit has a hip portion and a bust portion and wherein the piece of buoyancy material forms a substantially circumferential band substantially between the hip and the bust portions of the main body.

5. The swimsuit of claim 1, wherein the main body has hip portions and the swimsuit includes pieces of the buoyancy material connected only to the hip portions.

6. The swimsuit of claim 5, wherein the main body also has shoulder strap portions and the swimsuit includes pieces of the buoyancy material connected to the shoulder strap portions as well as the hip portions.

7. The swimsuit of claim 5, wherein the main body also has shoulder portions and the swimsuit includes pieces of the buoyancy material connected to the shoulder portions as well as the hip portions.

8. The swimsuit of claim 1, wherein said closed-cell foam material has a minimum void percentage of 80% by volume.

9. The swimsuit of claim 1, wherein said closed-cell foam material has an average density of 0.18 to 0.24 g/c.c.

10. The swimsuit of claim 1, wherein the piece of buoyancy material is interposed between two pieces of the textile material forming the main body.

11. A swimsuit arranged to be worn closely to the body of a user to enhance buoyancy, comprising:

a piece of textile material forming a main body of the swimsuit; and, a piece of flexible, elastic closed-cell foam buoyancy material interposed between two pieces of the textile material forming the main body and connected to the main body by first and second sets of spaced apart sew lines having stitches passing through only one of the two pieces wherein each set is in a skewed orientation with respect to each other and to a longitudinal axis defined by the user's body so that the buoyancy material remains substantially in contact with the user's body as the user swims.

12. The swimsuit of claim 11, wherein the first and second sets define an array of rhomboidal areas.

13. The swimsuit of claim 12, wherein the rhomboidal areas have major and minor axes positioned substantially transverse to the longitudinal axis.

14. The swimsuit of claim 11, wherein the swimsuit has a hip portion and a bust portion and wherein the piece of buoyancy material forms a substantially circumferential band substantially between the hip and the bust portions of the main body.

15. The swimsuit of claim 11, wherein the main body has hip portions and the swimsuit includes pieces of the buoyancy material connected only to the hip portions.

16. The swimsuit of claim 15, wherein the main body also has shoulder strap portions and the swimsuit includes pieces of the buoyancy material connected to the shoulder strap portions as well as the hip portions.

17. The swimsuit of claim 15, wherein the main body also has shoulder portions and the swimsuit includes pieces of the buoyancy material connected to the shoulder portions as well as the hip portions.

18. The swimsuit of claim 11, wherein said closed-cell foam material has a minimum void percentage of 80% by volume.

19. The swimsuit of claim 11, wherein said closed-cell foam material has an average density of 0.18 to 0.24 g/c.c.

20. A method for making an enhanced buoyancy swimsuit, comprising the steps of:

providing a piece of elastic textile fabric forming a main body of the swimsuit;

providing a piece of flexible, elastic closed-cell foam buoyancy material to add buoyancy to the swimsuit; and, sewing the buoyancy material to the main body in a pattern which is symmetrical about a longitudinal axis defined by the body of the user with a plurality of substantially parallel, spaced apart sew lines passing through the buoyancy material and the textile fabric at regular intervals and oriented substantially transverse to and skewed with respect to longitudinal and lateral axes defined by the body of the user so that the buoyancy material remains substantially in contact with the user's body as the user swims.

* * * * *